US010087705B2

(12) United States Patent
Atkins et al.

(10) Patent No.: US 10,087,705 B2
(45) Date of Patent: Oct. 2, 2018

(54) SEAL ASSEMBLY

(71) Applicant: Rubberatkins Limited, Aberdeen (GB)

(72) Inventors: Nicholas Atkins, Kincardinshire (GB); David Matthew Hare, Aberdeen (GB); Mike Allen, Insch (GB); Stephen Michael Rooney, Aberdeen (GB)

(73) Assignee: Rubberatkins Limited, Aberdeen, Scotland (GB)

( * ) Notice: Subject to any disclaimer, the term of this patent is extended or adjusted under 35 U.S.C. 154(b) by 0 days.

(21) Appl. No.: 14/787,072

(22) PCT Filed: May 2, 2014

(86) PCT No.: PCT/GB2014/051376

§ 371 (c)(1),
(2) Date: Oct. 26, 2015

(87) PCT Pub. No.: WO2014/177886

PCT Pub. Date: Nov. 6, 2014

(65) Prior Publication Data

US 2016/0076333 A1 Mar. 17, 2016

(30) Foreign Application Priority Data

May 3, 2013 (GB) ..... 1308045.2

(51) Int. Cl.
*F16L 55/12* (2006.01)
*E21B 33/12* (2006.01)
(Continued)

(52) U.S. Cl.
CPC ..... *E21B 33/126* (2013.01)

(58) Field of Classification Search
None
See application file for complete search history.

(56) References Cited

U.S. PATENT DOCUMENTS 4,375,240 A * 3/1983 Baugh ..... E21B 33/1295 166/120
4,658,860 A * 4/1987 Reaux ..... E21B 33/1295 138/89

(Continued)

FOREIGN PATENT DOCUMENTS

| | | |
|---|---|---|
| GB | 2109061 | 5/1983 |
| WO | 02/086281 A1 | 10/2002 |
| WO | 2012/098377 A2 | 7/2012 |

OTHER PUBLICATIONS

International Search Report and Written Opinion for International Application No. PCT/GB2014/051376 dated Jun. 9, 2015.

(Continued)

*Primary Examiner* — Matthew R Buck
*Assistant Examiner* — Douglas S Wood
(74) *Attorney, Agent, or Firm* — Carlson, Gaskey & Olds, P.C.

(57) ABSTRACT

A seal assembly for establishing a seal in an annulus between a mandrel and a bore wall includes a mandrel, a radially expandable seal element mounted on the mandrel, and a setting arrangement mounted on the mandrel and being arranged to displace the seal element radially outwardly from a retracted configuration to an extended configuration. The expandable seal element defines a cup seal when in the extended configuration.

30 Claims, 5 Drawing Sheets

(51) Int. Cl.

| | |
|---|---|
| ***E21B 33/03*** | (2006.01) |
| ***E21B 23/06*** | (2006.01) |
| ***E21B 33/126*** | (2006.01) |

(56) References Cited

U.S. PATENT DOCUMENTS

| | | | | |
|---|---|---|---|---|
| 5,678,635 | A * | 10/1997 | Dunlap | E21B 23/01 166/123 |
| 8,651,178 | B2 * | 2/2014 | Mercer | E21B 23/06 166/121 |
| 2004/0045722 | A1 | 3/2004 | Sangla | |
| 2009/0308592 | A1 | 12/2009 | Mercer et al. | |

OTHER PUBLICATIONS

United Kingdom Search Report for Application No. GB1308045.2 dated Oct. 16, 2013.

* cited by examiner

INITIAL CONFIGURATION

BALL DROP

1st SHEARS BREAK, RAM PORTS OPEN

PRESSURE ON RAM SETS CUP AND BACKUP

2nd SHEARS BREAK, WASH PORTS OPEN

SEAL ASSEMBLY

REFERENCE TO RELATED APPLICATIONS

This application is a United States National Phase application of PCT Application No. PCT/GB2014/051376 filed on May 2, 2014, which claims priority to United Kingdom Application No. 1308045.2 filed on May 3, 2013.

FIELD OF THE INVENTION

The present invention relates to a downhole seal assembly, such as a cup seal assembly, for use in establishing a seal in an annulus such as within a wellbore.

BACKGROUND TO THE INVENTION

Seal assemblies or packers are frequently used in the oil and gas industry for sealing an annulus in a wellbore, such as may exist between a bore wall and a mandrel. Such sealing may be achieved by use of annular components which are mounted on a mandrel and which extend between the mandrel and bore wall. Such annular sealing components may include annular sealing bands, cup seals, inflatable bladders, swellable elements and the like.

It is often required to provide a seal which is capable of being run into a wellbore while defining a minimal outer diameter, for example to pass through wellbore restrictions, and then be radially expanded to provide a seal against a bore wall. However, high expansion ratios are often difficult to achieve, and it is well known in the art that excessive expansion ratios are often only achievable at the expense of performance. For example, a highly expanded seal may perform poorly against high pressures and may be susceptible to axial leakage and extrusion.

SUMMARY OF THE INVENTION

According to a first aspect of the present invention, there is provided a seal assembly for establishing a seal in an annulus between a mandrel and a bore wall including a mandrel, a radially expandable seal element mounted on the mandrel, and a setting arrangement mounted on the mandrel and being arranged to displace the seal element radially outwardly from a retracted configuration to an extended configuration. The expandable seal element defines a cup seal when in the extended configuration.

In use, the sealing assembly may be located within a bore, such as a wellbore, pipe line or the like, and the setting arrangement may be activated to radially expand the seal element. When in the extended configuration, the seal element defines a cup seal, and thus responds to a pressure differential across the seal to establish and/or enhance a seal with a bore wall. As such, the present invention benefits from both the ability to radially expand the seal element, and from the seal element functioning as a cup seal when in the extended configuration.

The seal element may be engaged with a bore wall by action of the setting arrangement. Further, the action of the setting arrangement may define an interference between the seal element and a bore wall which is sufficient to provide a sealing function. That is, the expansion effect of the setting arrangement may be sufficient to press the seal element into engagement with the bore wall. In this arrangement, the cup seal functionality of the seal element may further enhance the seal with the bore wall, when exposed to a suitable pressure differential across the seal element.

The seal element may remain disengaged from a bore wall following expansion by the setting arrangement, and the cup seal functionality of the seal element may cause the seal element to be brought into engagement with the bore wall.

The setting arrangement may provide support to the seal element when in the extended configuration. This may assist the seal element to accommodate operational pressures and forces when extended and in sealing engagement with a bore wall. For example, such an arrangement may provide a degree of stability to the seal element when in the extended configuration, which may assist in resistance to extrusion forces and the like.

The entire seal element may be configured to be radially expanded. For example, the setting arrangement may be configured to displace the entire seal element radially outwardly.

In some embodiments, only a portion of the seal element may be configured to be radially expanded. For example, the setting arrangement may be configured to displace only a portion of the seal element radially outwardly.

In some embodiments, the seal element may include or define a fixed end region which is radially fixed, and thus prevented from radial expansion, and an opposite free end region which is configured to be radially expanded by the setting arrangement. Such an arrangement may permit the seal element to define a cup seal when in the extended configuration.

The fixed end of the seal element may define a seal with a further component or structure of the seal assembly. Such a seal may be provided by a bonded region of the seal element with a further component, for example an adhesive bond. In some embodiments, a mechanical seal, such as a gasket, o-ring or the like, may be provided between the fixed end of the seal element and a further component.

The seal element may be generally cylindrical when in the retracted configuration. In such an arrangement, the seal element may be arranged substantially coaxially with the mandrel.

The setting arrangement may be configured to deform the seal element to define a general cup-shape when in the extended configuration.

The seal element may define an annular gap with the mandrel. Such an annular gap may facilitate interaction with the setting arrangement. Further, such an annular gap may facilitate easier mounting of the seal element on the mandrel.

The seal element and the setting arrangement may be axially arranged relative to each other, for example in end-to-end relationship, and the seal element is in the retracted configuration. This arrangement may assist to minimize the outer diameter of the sealing assembly when the seal element is configured in the retracted configuration.

The seal element may define a ramp surface to facilitate inter-engagement with the setting arrangement. The ramp surface may be defined by a tapered or bevelled region of the seal element, such as an inwardly tapered region of the seal element. Where the seal element includes or defines a free end, the ramp surface may be provided on the free end. The ramp surface of the seal element may function to facilitate radial expansion by interaction with the setting arrangement. Further, the ramp surface may provide relief between the seal element and the setting arrangement when the seal element is in the extended configuration to permit the seal element to define and function appropriately as a cup seal.

The seal element may include or define a unitary component. In some embodiments, the seal element may include multiple components assembled together to define the seal element.

The seal element may include regions of increased stiffness. Such regions may provide stability and/or strength within the seal element, for example to assist in resisting operational forces, such as extrusion forces.

The seal element may include an elastic material. The seal element may include an elastomeric material, such as a rubber.

The seal element may include a swellable material, such as a swelling elastomer. The seal element may include a water swellable material. The seal element may include a hydrocarbon swellable material, such as an oil swellable material.

The setting arrangement may include a deflector configured for use in displacing the seal element radially outwardly. The seal element and deflector may be configured to be moved relative to each other to cause the seal element to be displaced radially outwardly.

The deflector may define a unitary component, such as a generally annular or ring component. In some embodiments, the deflector may be defined by multiple components.

The deflector may define a ramp surface, such as a tapered or wedge surface. The ramp surface may be linear or curved. The deflector may be generally conical or frusto-conical.

The seal element and deflector may be configured to be moved relative to each other to position the deflector between the seal element and the mandrel.

In some embodiments, the seal element and deflector may be configured to be moved axially relative to each other to cause the seal element to be displaced radially outwardly. The seal element and deflector may be configured to be moved rotationally relative to each other to cause the seal element to be displaced radially outwardly.

The setting arrangement may further include an actuator configured to provide relative movement between the seal element and the deflector. The actuator may be configured to displace the deflector. In some embodiments the deflector may be mounted on, secured to, engaged by or form an integral part of the actuator.

The actuator may be configured to displace the seal element. In some embodiments the seal element may be mounted on, secured to, engaged by or form an integral part of the actuator.

The setting arrangement may include a ram arrangement.

The ram arrangement may define an actuator configured to provide relative movement between the seal element and a deflector of the setting arrangement.

The ram arrangement may define an axial ram arrangement configured to provide relative axial movement of the seal element and a deflector of the setting arrangement.

The setting arrangement may be mechanically actuated. For example, the setting arrangement may be actuated by a motor or the like.

The setting arrangement may by fluid actuated, for example hydraulically or pneumatically actuated. The setting arrangement may include a piston. In one embodiment the setting arrangement may include an annular piston arranged coaxially with the mandrel.

The setting arrangement may be fluid actuated by fluid delivered via the mandrel. In one embodiment, the mandrel may define one or more fluid ports, such as radial ports, to permit fluid communication with the setting arrangement. The one or more fluid ports may be selectively opened to permit communication with the setting arrangement when required.

In one embodiment, the one or more fluid ports may be initially closed by a frangible barrier, such as a frangible disk, and elevated pressure within the mandrel may burst or rupture the frangible barrier, thus establishing communication between the mandrel and the ram arrangement.

The mandrel may include a sleeve arrangement including inner and outer coaxially arranged sleeves, each defining one or more fluid ports. In one configuration respective fluid ports in the sleeves may be misaligned with each other, thus closing any communication path between the mandrel and the setting arrangement. In another configuration respective fluid ports of the sleeves may be aligned, thus opening a communication path between the mandrel and the setting arrangement.

The sleeves may be actuated to move relative to each other to be reconfigured to selectively open the ports. Such sleeve actuation may be achieved by use of pressure within the mandrel. For example, the sleeves may be initially secured together via a releasable connection, such as a shearable connection (e.g., one or more shear screws), which is caused to be released in response to elevated pressure within the mandrel. In one embodiment the inner sleeve may define a seat configured to receive an activator member, such as a ball or dart dropped, pumped or otherwise driven through the mandrel, to seal the inner sleeve and permit pressure therein to be elevated to a sufficient level to cause the releasable connection with the outer sleeve to be released. Once the connection is released, fluid pressure acting against the sealed interface between the activator member and seat interface may cause the inner sleeve to move relative to the outer sleeve and cause alignment of respective ports.

The sleeve arrangement may be configured to selectively open ports through the mandrel for other purposes, for example to establish communication with a sealed annulus. Such communication may be provided to permit outflow from the mandrel, for example to communicate a fluid into the annulus. Such a fluid may include a f racing fluid, washing fluid, acid or the like. Such communication may be provided to permit inflow into the mandrel, for example to communicate a formation fluid, such as oil, gas, water or the like, into the mandrel.

The sleeve arrangement may define a staged activation procedure. For example, the sleeve arrangement may be configured to initially open a port or set of ports to provide communication between the mandrel and the setting arrangement and thus permit setting of the seal element, and subsequent to this open a second port or set of ports to provide communication with an annulus surrounding the mandrel. This subsequent stage may also close the first port or set of ports. Such closure of the first port or set of ports may function to lock the setting arrangement in pace to retain the seal element in its extended configuration.

The staged procedure may be provided by a variation in fluid pressures within the mandrel. The staged procedure may be provided by an appropriate series of releasable connectors between individual sleeves of the sleeve arrangement.

The setting arrangement may further include an intermediate member interposed between the seal element and a deflector of the setting arrangement. The intermediate member may be interposed between the seal element and the deflector when the seal element is both in the retracted and extended configurations. The intermediate member may be configured to also be expanded by the deflector.

The intermediate member may be configured to transmit a force between the deflector and the seal element, to permit the deflector to expand the seal element.

The intermediate member may be configured to become radially interposed between the deflector and the seal element when the seal element is in the extended configuration. The intermediate member may be arranged to become radially stacked with the seal element when the seal element is in the extended configuration. Such a stacked arrangement may facilitate an increased expansion ratio of the seal element. Further, the intermediate member may provide improved stability and/or strength to the seal element when in the extended configuration.

The intermediate member may define one or more ramp surfaces. The intermediate member may define a first ramp surface configured to engage the seal element to permit the seal element to be radially expanded. The first ramp surface of the intermediate member may function to provide a region of relief between the seal element and the intermediate member when the seal element is in the extended configuration to permit the seal element to define and function appropriately as a cup seal.

The intermediate member may include a second ramp surface configured to engage the deflector to permit the intermediate member to be radially expanded by the deflector.

In some embodiments the intermediate member may include only one of the first and second ramp surfaces.

The intermediate member may define a sealing function when in use. For example, a region of the intermediate member may define a sealing function. A region of the intermediate member may be arranged to react to pressure to assist with energising the seal element. For example, a region of the intermediate member may be configured to be exposed to a pressure which biases the intermediate member and the seal element towards the extended configuration.

The setting arrangement may include a plurality of intermediate members. Such a plurality of intermediate members may be configured to become radially stacked to increase the available expansion ratio of the seal element.

In particular embodiments the setting arrangement may include two intermediate members.

In embodiments including a plurality of intermediate members, at least one of the intermediate members may be different from at least other of the intermediate members. For example, at least one intermediate member may include a material of different hardness.

The intermediate member, or in embodiments including a plurality of intermediate members at least one intermediate member, may include a metal insert or may have metal moulded into it. Beneficially, this prevents or mitigates the risk that the intermediate member will slip out over the deflector.

The seal assembly may include a seal support arrangement configured to provide axial support to the seal element when the seal element is in the extended configuration. Such axial support may be provided to assist the seal element to resist operational axial forces, such as extrusion forces. The seal support arrangement may be configured to permit the seal element to accommodate a high expansion ratio, without compromising its intended sealing function.

The seal support arrangement may be reconfigurable between a retracted configuration and an extended configuration. The seal support arrangement may be configured in the extended configuration simultaneously with extension of the seal element. Alternatively, the seal support arrangement may be configured in the extended configuration before or after the seal element is extended.

The seal support arrangement may be activated to extend during the same activation event as the seal element.

The seal support arrangement may be activated to extend by inter-engagement with the seal element, such that the seal support arrangement will be extended as the seal element is extended.

In some embodiments the seal support arrangement may be configured to be extended by the setting arrangement, such that the setting arrangement is responsible for extending both the seal element and the seal support arrangement.

The seal support arrangement may include multiple support elements each configured to be radially extended to provide support to the seal element.

At least one support element may include a stiffer material than that of the seal element, and thus capable of providing stability and support to the seal element. At least one support element may include a rubber. At least one support element may include a metal or metal alloy.

The seal support arrangement may include a seal support deflector configured for use in displacing the support elements radially outwardly. The seal support deflector may define a unitary component, such as a generally annular or ring component. In some embodiments the seal support deflector may be defined by multiple components. For example, individual seal support deflector components may be arranged to interact with a respective support element.

The seal support deflector may define a ramp surface, such as a tapered or wedge surface. The ramp surface may be linear or curved. The seal support deflector may be generally conical or frusto-conical.

The seal support deflector may be mounted on the mandrel. The seal support deflector may be sealed relative to the mandrel, for example via an o-ring seal or the like.

The support elements and seal support deflector may be configured to be moved relative to each other to cause the support elements to be displaced radially outwardly.

The support elements and seal support deflector may be configured to be moved relative to each other to position the deflector between the support elements and the mandrel.

In some embodiments the support elements and seal support deflector may be configured to be moved axially relative to each other to cause the support elements to be displaced radially outwardly.

The seal support deflector may be configured to be moved axially relative to the support elements. For example, the setting arrangement may be configured to cause the seal support deflector to be moved axially.

The seal support arrangement may further include a limit ring mounted on the mandrel and configured to prevent or at least limit axial movement of the support elements, permitting the seal support deflector to be axially moved relative to the support elements. The limit ring may define any suitable profile to engage the support elements to appropriately limit axial movement thereof, while permitting the support elements to be radially extended.

The limit ring may also be configured to retain the support elements within the seal assembly.

In some embodiments, one or more of the support elements may be initially secured relative to the limit ring via a releasable connection, such as one or more shear screws. Such a releasable connection may be released, for example sheared, when a force is applied on the support members to cause the members to extend.

The seal support deflector may be engaged by the seal element, such that activation of the seal element to be extended by the setting arrangement may cause the seal support deflector to be moved axially and thus extend the support elements. That is, a setting force established by the setting arrangement may be transmitted to the seal support deflector via the seal element. For example, the seal element may be caused to be moved both radially and axially by the setting arrangement, and the axial movement may be applied to the seal support deflector to cause corresponding axial movement of the deflector.

One end region of the seal element may be engaged with the seal support deflector. One end region of the seal element may be secured to the seal support deflector. Such securing of the seal element to the seal support deflector may radially fix the end of the seal element such that radial expansion of the end is not permitted, or is at least restricted. Such an arrangement may permit an opposite end region of the seal element to be extended, and thus define a cup seal.

At least one support element may be connected to the seal support deflector. Such a connection may permit the support element to be extended and/or retracted, but prevent any separation between the elements and the deflector. Such a connection may be achieved via a screw and slot connection, dovetail connection or the like.

At least one support element may be configured to rotated about a pivot point to be moved to the extended configuration.

The support elements and seal support deflector may define corresponding curved surfaces which interengage to permit the support elements to be rotated. In such an arrangement the support elements may be configured to slide in a rocking motion relative to the seal support deflector.

At least one and in some embodiments all support elements may include a planar portion or surface which may be contiguous with a curved surface. The planar portion or surface may be arranged to be engaged with the mandrel, such as the outer surface of the mandrel, when the support element is moved to an extended configuration. Such an arrangement may assist to prevent over-rotation or extension of the support element. Further, when a pressure load is applied during use of the seal assembly, engagement of the planar surface of a support element may assist to prevent pivoting of the seal element about or relative to a limit ring. Such an arrangement may minimize loading applied to a connection arrangement between the support element and seal support deflector.

In one embodiment, the pivot point of at least one support element may be defined within the bulk, form or constitution of the respective element.

In some embodiments, the pivot point of at least one support element may be located externally of the respective support element. Such an external pivot point may be defined as a virtual or effective pivot point. This arrangement may be achieved by providing corresponding curved engaging surfaces on the element and the seal support deflector.

The pivot point of at least one support element may be located radially outwardly of a maximum outer dimension of the respective support element when in the extended configuration. Such an arrangement may permit the support element to be biased towards a retracted configuration upon engagement of an external object. This may assist to prevent snagging or the like of the seal assembly, and in particular of the support elements of the seal assembly when passing through a bore.

The pivot point of at least one support element may be located radially outwardly of a wall of a bore within which the seal assembly is located.

In one embodiment, the seal support arrangement may include a plurality of support elements mounted on a common structure, such as a ring structure located on the mandrel. In some embodiments, each support element may define a petal or tab extending from a common structure, for example extending axially from such a common structure.

The seal assembly may include a seal back-up arrangement associated with the seal element. The seal back-up arrangement may be arranged to extend over at least a portion of the outer surface of the seal element. The seal back-up arrangement may further assist to support the seal element when the element is in an extended configuration, for example to assist in resisting extrusion of the seal element.

The seal back-up arrangement may include an annular structure.

The seal back-up arrangement may be radially extended in response to extension of the seal element.

The seal back-up arrangement may be arranged to be interposed between the seal element and the seal support arrangement. For example, individual seal support elements of the seal support arrangement may directly engage the seal back-up arrangement.

The seal back-up arrangement may include a plurality of circumferentially arranged petals or tabs, such as generally axially extending petals or tabs. Such petals or tabs may be configured to be radially extended upon extension of the seal element.

The seal back-up arrangement may be configured to span at least one circumferential gap between adjacent support elements of a seal support arrangement. Such an arrangement may assist to minimize extrusion of the seal element through such a circumferential gap.

At least one petal or tab of the seal back-up arrangement may span at least one circumferential gap between adjacent support elements of a seal support arrangement. In one embodiment each petal or tab of the seal back-up arrangement may span at least one circumferential gap between adjacent support elements of a seal support arrangement.

The seal assembly may include a second seal element and a second setting assembly mounted on the mandrel. Such an arrangement may permit a seal to be established in two axially spaced locations, defining an isolated annulus region or zone between seal elements. The mandrel may be configured to permit fluid communication, for example selective fluid communication with the isolated annulus region, such as in the ported manner defined above.

In some embodiments the seal element and/or seal support arrangement may be retractable, for example by use of the setting arrangement, by use of appropriate biasing means and the like.

The mandrel may include or define a tubular member. The mandrel may define or form part of a tubing string, such as a production tubing string.

The mandrel may form part of a tool, such as a bridge plug, straddle tool, zonal isolation tool, fracing tool, or the like.

According to a second aspect of the present invention, there is provided a method for establishing or setting a seal within an annulus between a mandrel and a bore wall, including running a mandrel carrying an expandable seal element and a setting arrangement into a bore, and actuating the setting arrangement to displace the seal element radially outward from a retracted configuration to an extended configuration to define a cup seal.

The method according to the second aspect may be performed by use of the seal assembly according to the first aspect.

According to a third aspect of the present invention, there is provided a seal assembly for establishing a seal in an annulus between a mandrel and a bore wall, including a mandrel, a radially expandable seal element mounted on the mandrel, a seal support arrangement mounted on the mandrel and in engagement with the seal element, and a setting arrangement mounted on the mandrel and being arranged to displace the seal element radially outwardly from a retracted configuration to an extended configuration, and to cause the seal element to initiate radial extension of the seal support arrangement.

The seal support arrangement may be provided as described above in relation to the first aspect.

According to a fourth aspect of the present invention, there is provided a seal assembly for establishing a seal in an annulus between a mandrel and a bore wall, including a mandrel, a radially extendable seal element mounted on the mandrel, a radially extendable seal support assembly, and a setting arrangement mounted on the mandrel. The seal element is interposed between the setting arrangement and the extendable seal support assembly and the setting arrangement is configured to apply a setting force on the seal element, and in turn the seal element is configured to apply a setting force on the seal support assembly to radially extend both the seal element and the seal support assembly According to a fifth aspect of the present invention, there is provided a seal assembly for establishing a seal in an annulus between a mandrel and a bore wall, including a mandrel, a radially expandable seal element mounted on the mandrel, and a setting arrangement mounted on the mandrel and comprising an actuator and an intermediate member arranged between the actuator and the seal element. The actuator is configured to drive the intermediate member beneath the seal element to radially stack the intermediate member and the seal element and cause the seal element to be expanded.

The setting arrangement may include a plurality of intermediate members which are radially stacked to expand the seal element.

According to a sixth aspect of the present invention there is provided a seal assembly for establishing a seal in an annulus between a mandrel and a bore wall, including a radially expandable seal element, and a setting arrangement for displacing the seal element radially outwardly from a retracted configuration to an extended configuration. The expandable seal element defines a cup seal when in the extended configuration.

According to a seventh aspect of the invention, there is provided apparatus for sealing an annulus around a tubular member, the apparatus including a tubular member, a deformable sealing element retained around the tubular member and having a sealing portion, and a setting element slidably retained around the tubular member. The setting element is operable to slide to a deployed position in which the setting element is between the tubular member and the sealing portion of the sealing element, to thereby increase the external diameter of the sealing portion.

The setting element may force the sealing portion of the sealing element outward in relation to the tubular member, so as to increase the external diameter of the sealing portion. The external diameter of the sealing portion may be increased by an amount equal to some or all of the thickness of the setting element.

The setting element may be operable to slide between a first, withdrawn position in which the sealing element is in a relaxed configuration, and a second, deployed position in which the setting element is between the tubular member and the sealing portion and the sealing element is in a deformed configuration.

In some embodiments, the sealing element is resilient. When the setting element slides to the deployed position, at least a part of the resilient sealing element undergoes elastic deformation. However the invention is not limited to apparatus comprising a resilient sealing element.

The setting element may be biased away from the deployed position and may be biased towards the withdrawn position.

The setting element may be biased by the sealing element. For example, in a deformed configuration, stress in the sealing element may exert a biasing force on the setting element. Thus, in the absence of sufficient force biasing the setting element towards the deployed position or deforming the sealing element, the setting element and the sealing element may be in, or may revert to the initial withdrawn position and relaxed configuration, respectively.

In use, a fluid pressure differential in the annulus across the sealing element may force the sealing portion into sealing engagement with a wall defining the annulus. Alternatively, the setting element may force the sealing portion into sealing engagement with a wall defining the annulus. A fluid pressure differential in the annulus across the sealing element may strengthen the seal between the sealing portion and the wall.

According to an eighth aspect of the present invention, there is provided an apparatus for sealing an annulus around a tubular member, the apparatus including a tubular member, a deformable sealing element slidably retained around the tubular member, and a seal backup operatively engaged with the sealing element. The sealing element is operable to slide between a first position in which the sealing element is in a relaxed configuration and is operatively engaged with the seal backup in a retraced position, and a second position in which the sealing element is in a deformed configuration and is operatively engaged with the seal backup in an extended configuration, in which the seal backup supports at least a part of the sealing element.

According to a ninth aspect of the present invention, there is provided a seal support apparatus for use in supporting a downhole seal.

The seal support apparatus may be provided in accordance with the seal support arrangement defined above in relation to any other aspect.

The seal support apparatus may be suitable for use in axially supporting a downhole seal.

The seal support apparatus may be suitable for use in supporting a seal element or elements of a downhole seal.

The seal support apparatus may include a plurality of radially extendable support elements, and a support deflector for radially displacing the support elements radially outwardly. The support deflector may define a ramp surface, such as a tapered or wedge surface. The ramp surface may be linear or curved. The support deflector may be generally conical or frusto-conical.

The support deflector may be mounted on a mandrel. The support deflector may be sealed relative to the mandrel, for example via an o-ring seal or the like.

The support elements and support deflector may be configured to be moved relative to each other to cause the support elements to be displaced radially outwardly.

The support elements and support deflector may be configured to be moved relative to each other to position the deflector between the support elements and the mandrel.

In some embodiments, the support elements and support deflector may be configured to be moved axially relative to each other to cause the support elements to be displaced radially outwardly.

The support deflector may be configured to be moved axially relative to the support elements. For example, a setting arrangement may be configured to cause the support deflector to be moved axially.

The seal support apparatus may further include a limit ring mounted on the mandrel and configured to prevent or at least limit axial movement of the support elements, permitting the support deflector to be axially moved relative to the support elements. The limit ring may define any suitable profile to engage the support elements to appropriately limit axial movement thereof, while permitting the support elements to be radially extended.

The limit ring may also be configured to retain the support elements within the seal support apparatus.

In some embodiments, one or more of the support elements may be initially secured relative to the limit ring via a releasable connection, such as one or more shear screws. Such a releasable connection may be released, for example sheared, when a force is applied on the support members to cause the members to extend.

The support deflector may be engaged by a seal element of a downhole seal. In some embodiments, activation of the seal element to be radially extended, for example, by a setting arrangement may cause the support deflector to be moved axially and thus extend the support elements. That is, a setting force established by a setting arrangement may be transmitted to the support deflector via the seal element. For example, the seal element may be caused to be moved both radially and axially by the setting arrangement, and the axial movement may be applied to the support deflector to cause corresponding axial movement of the deflector.

One end region of an associated seal element may be engaged with the support deflector. One end region of an associated seal element may be secured to the support deflector. Such securing of an associated seal element to the support deflector may radially fix the end of the seal element such that radial expansion of the end is not permitted, or is at least restricted. Such an arrangement may permit an opposite end region of the seal element to be extended, for example to define a cup seal.

At least one support element may be connected to the support deflector. Such a connection may permit the support element to be extended and/or retracted, but prevent any separation between the elements and the deflector. Such a connection may be achieved via a screw and slot connection, dovetail connection or the like.

At least one support element may be configured to rotated about a pivot point to be moved to the extended configuration.

The support elements and support deflector may define corresponding curved surfaces which interengage to permit the support elements to be rotated. In such an arrangement the support elements may be configured to slide in a rocking motion relative to the support deflector.

At least one and in some embodiments all support elements may include a planar portion or surface which may be contiguous with a curved surface. The planar portion or surface may be arranged to be engaged with a mandrel, such as the outer surface of a mandrel, when the support element is moved to an extended configuration. Such an arrangement may assist to prevent over-rotation or extension of the support element. Further, when a load is applied during use, engagement of the planar surface of a support element may assist to prevent pivoting of the seal element about or relative to a limit ring. Such an arrangement may minimize loading applied to a connection arrangement between the support element and support deflector.

In one embodiment, the pivot point of at least one support element may be defined within the bulk, form or constitution of the respective element.

In some embodiments, the pivot point of at least one support element may be located externally of the respective support element. Such an external pivot point may be defined as a virtual or effective pivot point. This arrangement may be achieved by providing corresponding curved engaging surfaces on the element and the support deflector.

The pivot point of at least one support element may be located radially outwardly of a maximum outer dimension of the respective support element when in the extended configuration. Such an arrangement may permit the support element to be biased towards a retracted configuration upon engagement of an external object. This may assist to prevent snagging or the like of the seal support apparatus, and in particular of the support elements when passing through a bore.

The pivot point of at least one support element may be located radially outwardly of a wall of a bore within which the seal support apparatus is located.

In one embodiment, the seal support apparatus may include a plurality of support elements mounted on a common structure, such as a ring structure located on a mandrel. In some embodiments each support element may define a petal or tab extending from a common structure, for example extending axially from such a common structure.

The seal support apparatus may include a seal back-up arrangement associated with a seal element. The seal back-up arrangement may be arranged to extend over at least a portion of the outer surface of a seal element. The seal back-up arrangement may further assist to support the seal element when the element is in an extended configuration, for example to assist in resisting extrusion of the seal element.

The seal back-up arrangement may include an annular structure.

The seal back-up arrangement may be radially extended in response to extension of a seal element.

The seal back-up arrangement may be arranged to be interposed between the seal element and the seal support elements. For example, individual seal support elements of the seal support arrangement may directly engage the seal back-up arrangement.

The seal back-up arrangement may include a plurality of circumferentially arranged petals or tabs, such as generally axially extending petals or tabs. Such petals or tabs may be configured to be radially extended upon extension of a seal element.

The seal back-up arrangement may be configured to span at least one circumferential gap between adjacent support elements. Such an arrangement may assist to minimize extrusion of the seal element through such a circumferential gap.

At least one petal or tab of the seal back-up arrangement may span at least one circumferential gap between adjacent support elements. In one embodiment each petal or tab of the seal back-up arrangement may span at least one circumferential gap between adjacent support elements.

It should be understood that features defined in relation to one aspect may be applied in combination with any other aspect. It should be understood that the features defined above in accordance with any aspect of the present invention or below in relation to any specific embodiment of the invention may be utilised, either alone or in combination with any other defined feature, in any other aspect or embodiment of the invention.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
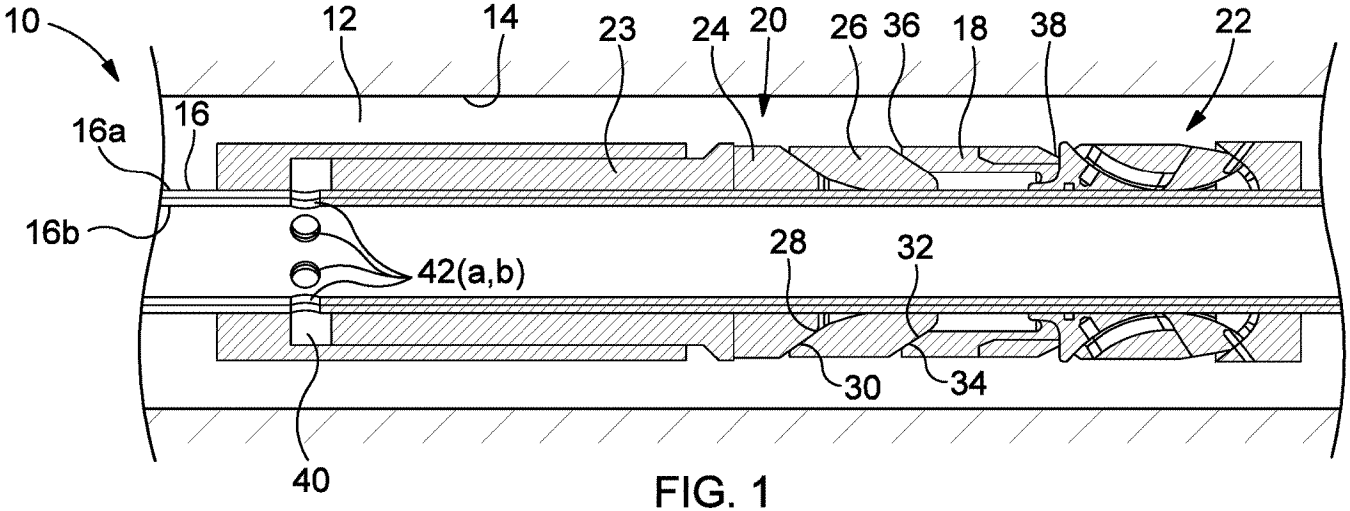
FIG. 1 is a cross-sectional view of a seal assembly, according to an embodiment of the present invention, shown in a retracted configuration.
Figure 2:
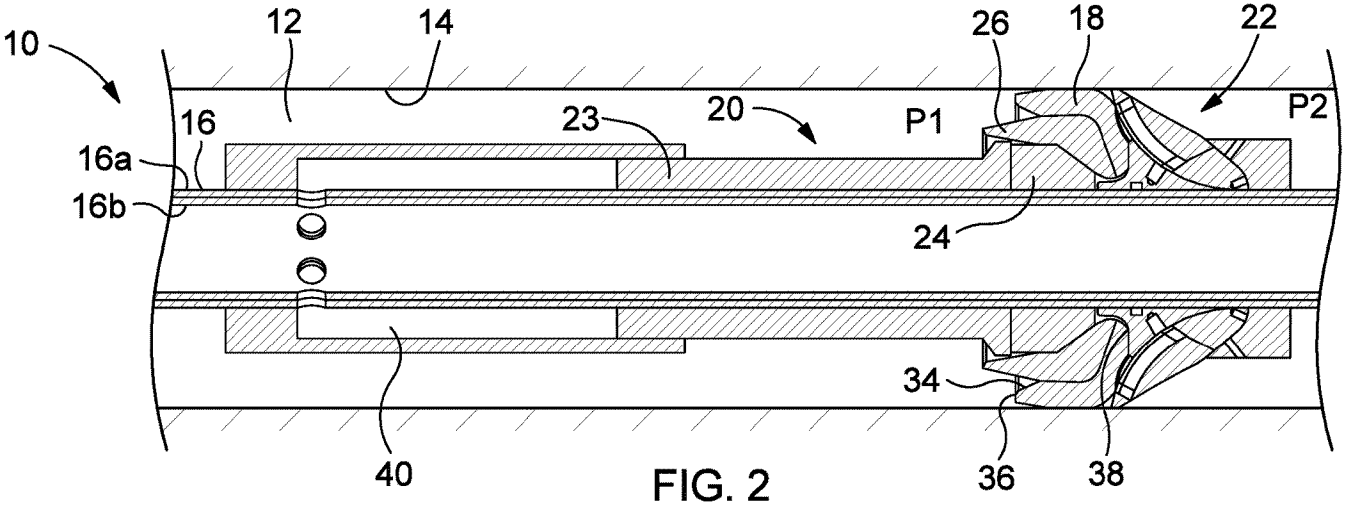
FIG. 2 is a cross-sectional view of the seal assembly of FIG. 1, shown in an extended configuration.

A cross-sectional view of a sealing assembly, generally identified by reference numeral 10, is shown in FIGS. 1 and 2, and the assembly 10 is shown in a retracted configuration in FIG. 1, and in an extended configuration in FIG. 2. The sealing assembly 10 may be used in multiple applications, and in the present embodiment is for use in providing a seal in an annulus 12 defined between the seal assembly 10 and a wall 14 of a wellbore. The bore wall 14 may be defined by an open drilled bore, a lined or cased bore, a pipe line or the like.

The sealing assembly 10 includes a mandrel 16 which supports a radially expandable seal element 18 and a setting arrangement 20 which, as will be described in further detail below, is for use in displacing the seal element 18 radially outwardly from a retracted configuration (FIG. 1) to an extended configuration (FIG. 2) to engage and seal against the bore wall 14. The sealing assembly 10 further includes a seal support arrangement 22 which provides axial support to the seal element 18 when extended, as will also be described in further detail below.

As shown in FIG. 1, the seal element 18 is generally cylindrical when in its retracted configuration, thus assisting to define a minimal outer diameter. This may assist in passing the seal assembly 10 through any restrictions to reach a target location within the bore. Further, as shown in FIG. 2, the seal element 18 defines a cup seal form when in its extended configuration. Accordingly, when the seal element 18 is extended it responds to a pressure differential across the seal (and P1>P2) to establish and/or enhance a seal with the bore wall 14. As such, the present invention benefits from both the ability to radially expand the seal element 18, and from the seal element 18 functioning as a cup seal when in the extended configuration.

The setting arrangement 20 includes an annular ram 23, a deflector 24 mounted or engaged with an end of the ram 23, and an intermediate member 26 which is interposed between the deflector 24 and the seal element 18. The deflector 24 includes a ramp surface 28 which interengages a corresponding ramp surface 30 formed on one end of the intermediate member 26. An opposite end of the intermediate member 26 also includes a ramp surface 32, which interengages a corresponding ramp surface 34 formed on a free end region 36 of the seal element 18. An opposite axial end of the seal element 18 defines a fixed end region 38 which is secured and sealed with the seal support arrangement 22, such that this fixed end 38 is restrained against radial expansion.

In use, the ram 23 is hydraulically actuated to stroke axially, such that interengagement of the various ramp surfaces 28, 30, 32, 34 cause the deflector 24, intermediate member 26 and the free end 36 of the seal element 18 to become radially stacked, one on top of the other, thus effecting radial expansion of the seal element 18. As the end region 38 of the seal element 18 is radially fixed, the seal element 18 is deformed by the setting arrangement 20 to define a cup shape. Further, the presence of the ramp surface 34 on the free end region 36 of the seal element 18 permits this end region 36 to be spaced from the intermediate member 26 when in the extended configuration, thus allowing the seal element 18 to better function as a cup seal.

The presence of the intermediate member 26 enables the seal element 18 to define a significant expansion ratio. In this respect, in other embodiments multiple intermediate members may be provided to increase the possible expansion ratio.

The ram 23 is hydraulically actuated by fluid which is delivered via the mandrel 16 into a piston chamber 40 via fluid ports 42. As will be described in more detail below, the mandrel includes outer and inner coaxially arranged sleeves 16*a*, 16*b* which each define radial ports 42*a*, 42*b*. The sleeves 16*a*, 16*b* may be arranged such that the respective ports 42*a*, 42*b* are offset from each other, thus closing any communication between the mandrel 16 and the piston chamber 40. The sleeves 16*a*, 16*b* may be capable of being moved relative to each other to align the respective ports 42*a*, 42*b* to permit communication between the mandrel 16 and the piston chamber 40.

As noted above, the seal assembly 10 further includes a seal support arrangement 22, which is expanded to provide axial support to the seal element 18. Such axial support may assist the seal element 18 to resist extrusion caused by a pressure differential in the annulus 12 across the seal.

Figure 4:
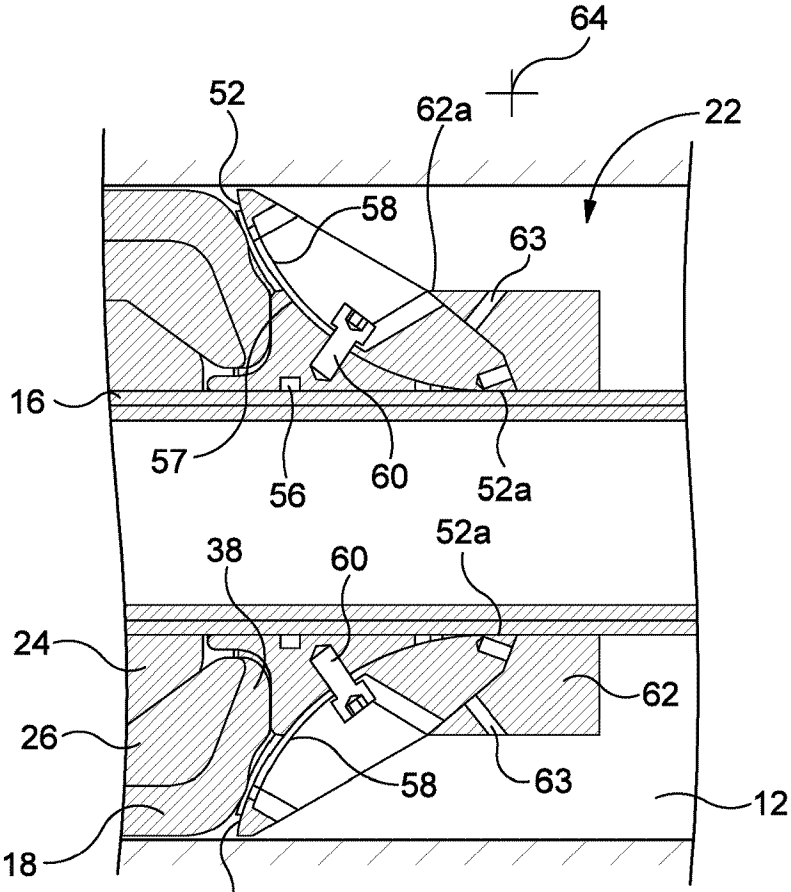
FIG. 4 shows the seal back-up system of FIG. 3, shown in an extended configuration.
Figure 3:
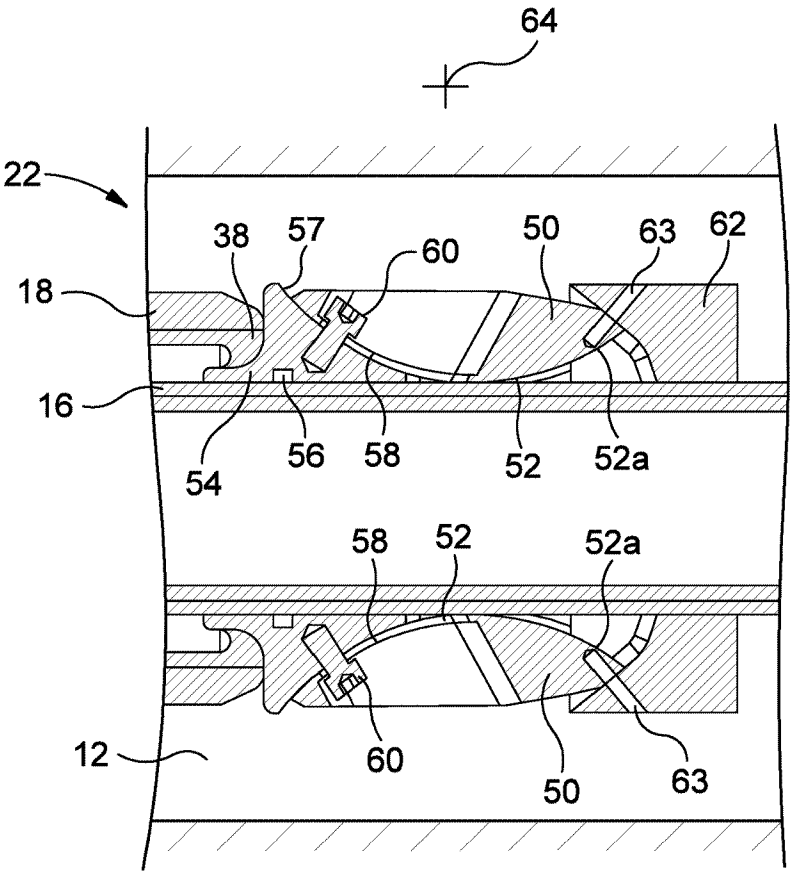
FIG. 3 is an enlarged view of a seal back-up system which forms part of the seal assembly of FIG. 1, and the seal back-up system is shown in a retracted configuration.

Enlarged views in the region of the seal support arrangement 22 are shown in FIGS. 3 and 4, reference to which is now made, and FIG. 3 shows the support arrangement in a retracted configuration, and FIG. 4 shows the support arrangement in an extended configuration.

The seal support arrangement includes a plurality of support members 50 which are arranged circumferentially around the mandrel 16, and each member 50 defines a lower or inner surface which includes a curved portion 52 and a substantially planer portion 52*a* which is rearward of and contiguous with the curved portion 52. The seal support arrangement 22 also includes a support member deflector 54 in the form of a ring which is mounted around the mandrel 16 and is sealed relative thereto via an o-ring 56. The fixed end 38 of the seal element 18 is secured to the deflector 54 such that any force applied through the seal element 18 may be directed into the deflector 54. The deflector 54 also defines a curved surface 57, which is arranged to cooperate with the curved surface 52 of each member 50. Each member 50 includes a slot 58 in the respective curved surfaces 52 which are arranged to be secured to the deflector 54 via respective screws 60. The connection between the slots 58 and screws 60 is such that the curved surfaces 52, 57 may slide relative to each other, but are prevented from separation.

The seal support arrangement 22 further includes an end ring 62 which is secured to the mandrel 16 and functions as a no-go to restrict axial movement of the members 50, and to provide a reaction point for the force applied by the ram 23 (FIGS. 1 and 2). The individual members 50 are initially secured to the end ring 62 via respective shear screws 63 such that the members 50 are positively held in the retracted configuration. Upon application of a suitable setting force the screws 63 will shear and permit the members 50 to become extended.

In use, the setting force applied by the ram 23 of the setting arrangement 20 will be transmitted to the deflector 54 via the seal element 18, causing the deflector 54 to be displaced axially along the mandrel 16, such that interengagement of the curved surfaces 52, 57 of the members 50 and the deflector 54 will cause the members 50 to rock or pivot and be extended radially outwardly, following shearing of the respective shear screws 63. When extended, the members 50 may provide axial support to the seal element 18, as shown in FIG. 4. As illustrated in the present embodiment, the members 50 may physically engage the seal element 18 when extended.

When the members 50 are fully extended, as shown in FIG. 4, the respective planer portions 52*a* become engaged with the outer surface of the mandrel 16. Further, the end ring 62 defines a profile, which compliments the profile of the members 50 when fully extended. This arrangement may provide robust support to the members 50 when in their extended configuration. For example, this may assist to prevent over rotation or extension of the members 50, for example to prevent pivoting of the members about a tip portion 62*a* of the end ring 62, which may otherwise occur in the event of continued axial forces applied by a contained pressure differential across the seal. Also, this arrangement may minimize the forces applied on the screws 60, as the screws may not be entirely responsible for retaining the members 50 in place when extended.

The form of the members 50 and deflector 54 is such that the members 50 are caused to pivot about respective pivot axes, which are removed or located externally of the members 50. In such an arrangement, the pivot points may be defined as virtual or effective pivot points. As an example in FIGS. 3 and 4, a pivot point 64 of the upper most illustrated member 50 is shown, which as noted above is located externally of the member 50. In particular, this pivot point 64 (and the pivot points of all the members 50) is located radially outwardly of the maximum extended dimension of the members 50, which may be defined by the bore wall 14. Such a selected location of the pivot point 64 may permit the members 50 to be biased to move towards a retracted configuration in the event of snagging or engaging an object in the bore annulus 12 in any direction. As such, when the sealing assembly 10 is being run through a bore in any direction, any snagging of an extended member 50 with an object in the bore will cause the member 50 to move towards its retracted configuration, thus permitting the seal assembly 10 to continue through the bore.

The sealing assembly 10 may be used in many applications where an annular bore seal is required. One such example will now be described with reference to FIGS. 5A to 5E, which illustrate a tool, generally identified by reference numeral 70, which incorporates multiple seal assemblies of the type described above, and the tool 70 is shown in different stages of operation.

The tool 70 includes two axially spaced sealing assemblies 10A, 10B which are similar to the sealing assembly 10 described above, and as such no further specific description will be given. However, generally, each sealing assembly 10A, 10B includes a seal element 18A, 18B, a setting arrangement 20A, 20B and a seal support arrangement 22A, 22B, all mounted on a common mandrel 16. The sealing assemblies 10A, 10B are arranged in back-to-back relationship with each other.

The common mandrel 16, as above, includes outer and inner coaxially arranged sleeves 16*a*, 16*b*. The outer sleeve 16*a* may define a portion of a tubing string, and may facilitate connection of the tool 70 to a tubing string, work string or the like. The outer sleeve 16*a* defines upper and lower seal setting ports 72*a*, and intermediate wash ports 74*a*, and the inner sleeve 16*b* defines corresponding upper and lower seal setting ports 72*b*, and intermediate wash ports 74*b*. As will be described in further detail below, relative movement between the sleeves 16*a*, 16*b* will cause the various ports to be selectively aligned and misaligned, thus providing appropriate control of the tool 70.

The inner sleeve 16*b* includes a seat portion 76 mounted on an inner surface thereof, and the outer sleeve includes first, second and third collars 78, 80, 82 axially spaced along and secured to its inner surface.

Figure 5A:
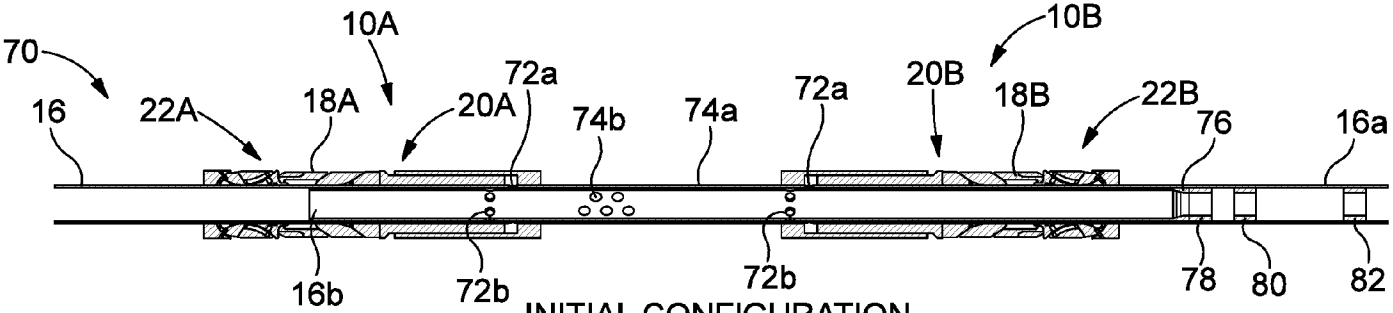
FIGS. 5A to 5E illustrate a tool which incorporates the seal assembly first shown in FIG. 1, shown in different stages of operation.

When the tool 70 is configured in its initial configuration, as illustrated in FIG. 5A, which is suitable for running into a bore (not shown) to the required depth, the seal assemblies 10A, 10B are fully retracted and the various ports 72*a*, 72*b*, 74*a*, 74*b*, 76*a*, 76*b* are all misaligned such that fluid communication through the wall of the mandrel 16 is prevented. Further, the lower end of the inner mandrel sleeve 16*b*, and specifically the seat 76, is located against the first collar 78.

Figure 5B:
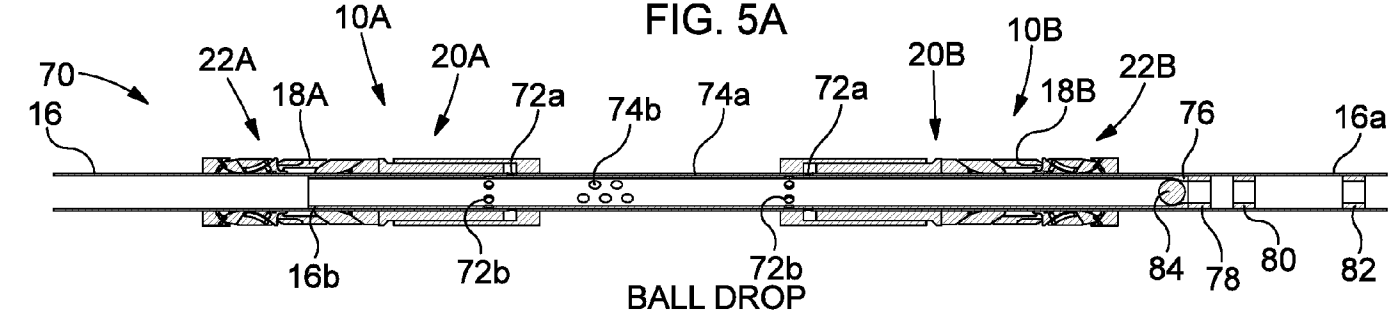
Figure 5C:
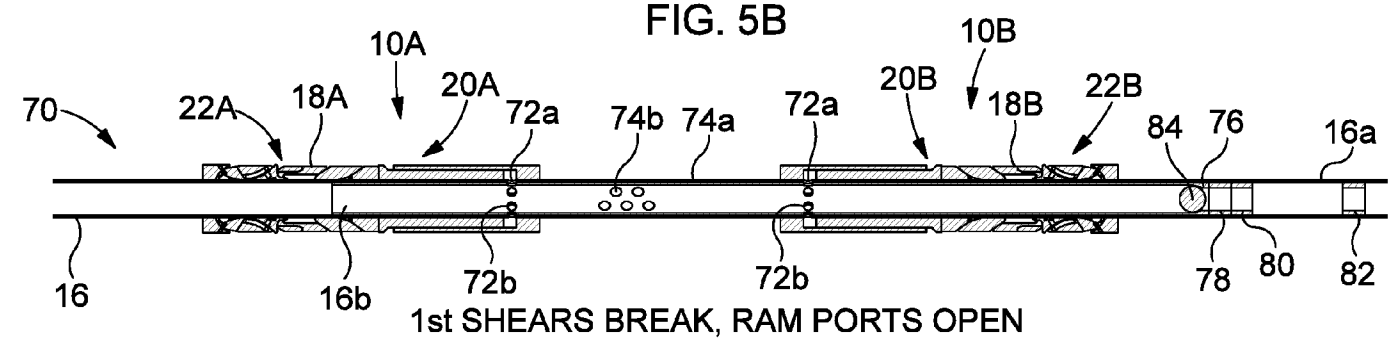
Figure 5D:
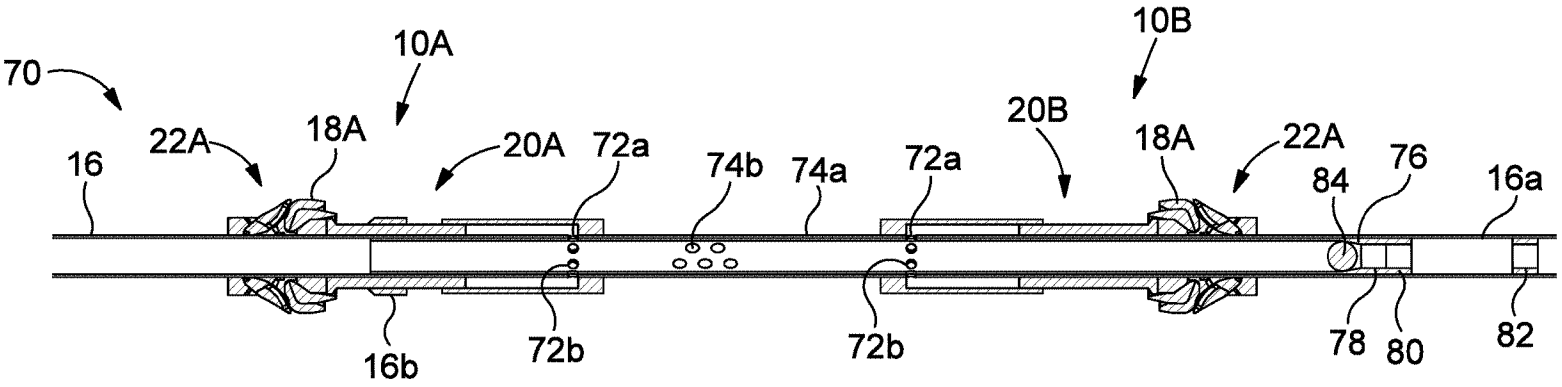

When the tool 70 is to be activated to set the seal assemblies 10A, 10B a ball 84 is dropped through the mandrel 16 until the ball 84 sealingly engages the seat 76, as illustrated in FIG. 5B. This permits pressure within the mandrel 16 to be elevated to a level which shears the first collar 78 from the outer sleeve 16*a*, causing the inner sleeve 16*b* to move downwardly relative to the outer sleeve 16*a* until the sheared first collar 78 engages the second collar 80, as illustrated in FIG. 5C. At this point, the seal setting ports 72*a*, 72*b* of the sleeves 16*a*, 16*b* are aligned, thus permitting fluid to be communicated with the setting arrangement 20A, 20B of each sealing assembly, allowing the seal elements 18A, 18B to be extended, along with the respective seal support arrangements 22A, 22B, as illustrated in FIG. 5D. It will be noted that at this stage the wash ports 74*a*, 74*b* of the sleeves 16*a*, 16*b* remain misaligned and thus closed.

Figure 5E:
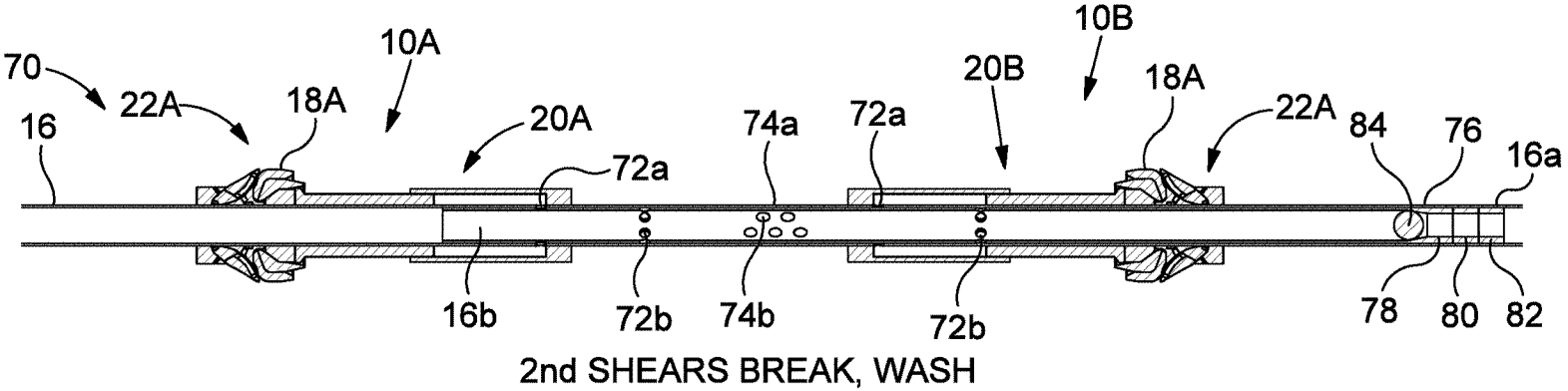

Once the sealing assemblies 10A, 10B are appropriately set, pressure may again become elevated within the mandrel 16 until the second collar 80 is sheared from the outer sleeve 16*a*, thus permitting further downward movement of the inner sleeve 16*b* until the second collar 80 engages the third collar 82, as illustrated in FIG. 5E. This downward movement may cause the seal setting ports 72*a*, 72*b* to become misaligned and thus closed, assisting to retain the sealing assemblies 10A, 10B in their extended configuration. Furthermore, such further downward movement of the inner sleeve 16*b* will permit the wash ports 74*a*, 74*b* to become aligned and thus opened to permit communication of fluid from within the mandrel into the isolated section of a bore between the sealing assemblies 10A, 10B. This wash fluid may be used for any required purpose, such as for a treating purpose, for example acid stimulation, f racing or the like. Alternatively, or additionally, this wash fluid may be used to increase the pressure in the bore between the sealing assemblies 10A, 10B to enable the cup sealing functionality to improve the set seals.

In the sealing assembly 10 first shown in FIG. 1, the support arrangement 22 functions to axially support the seal element 18, for example to assist in preventing extrusion of the seal element 18 along the annulus 12 when exposed to elevated pressure differentials. In some embodiments, to further assist with seal support, a seal back-up assembly may be used, which will now be exemplified with reference to FIG. 6.

Figure 6:
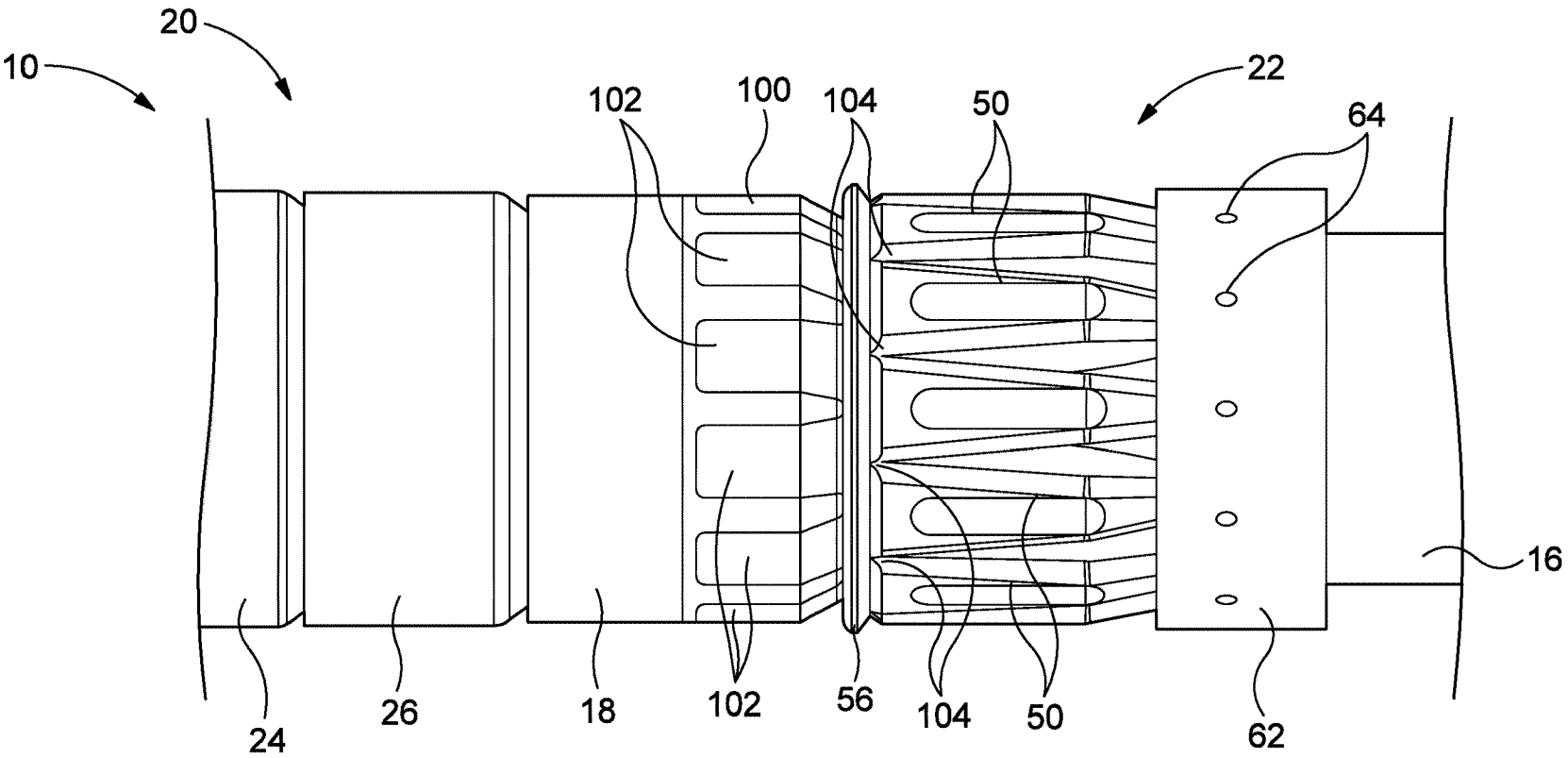
FIG. 6 shows a seal assembly according to a modified embodiment of the present invention.

FIG. 6 illustrates a seal assembly 10 of almost identical form to that shown in FIG. 1, and as such like components share like reference numerals. As such, the assembly 10 includes a seal element 18, a setting arrangement 20 and a support arrangement 22. As before, the setting arrangement includes a deflector 24 and an intermediate member 26. Also, the support arrangement 22 includes a plurality of support members 50, a deflector 56 and an end ring 62. No further description of these components will be given.

In this modified embodiment the apparatus 10 further includes a seal back-up assembly 100, which extends over one end of the seal element 18, and is positioned intermediate the seal element and the support arrangement 22. The back-up assembly 100 is of a petal type, and includes a plurality of circumferentially arranged petals 102 which extend over an outer surface of the seal element 18. As the seal element 18 is expanded, as shown in FIG. 2, these petals 102 also expand, and become engaged by the individual members 50 of the support arrangement 22.

The petals 102 are arranged such that they are each aligned with a circumferential gap 104 between adjacent members 50. Thus, the petals 102 may bridge such gaps 104 and as such, further assist in preventing extrusion of the seal element 18 when in use.

It should be understood that the embodiments described above are merely exemplary and that various modifications may be made thereto without departing from the scope of the invention.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

The invention claimed is:

1. A seal assembly for establishing a seal in an annulus between a mandrel and a bore wall, comprising:

a radially expandable seal element; and a setting arrangement for displacing the seal element radially outwardly from a retracted configuration to an extended configuration, wherein the setting arrangement comprises a deflector operable to displace the seal element radially outwardly and an intermediate member interposed between the seal element and the deflector, the seal element, the intermediate member and the deflector being axially slidable relative to each other and the mandrel to position the deflector and the intermediate member between the seal element and the mandrel in a radially stacked configuration to affect the radial expansion of the seal element, wherein the expandable seal element defines a cup seal when in the extended configuration, wherein the seal element comprising a fixed end region which is radially fixed, and an opposite free end region which is configured to be radially expanded by the setting arrangement.

2. The seal assembly according to claim 1, wherein the setting arrangement supports the seal element when in the extended configuration.

3. The seal assembly according to claim 1, wherein the free end of the seal element defines a ramp surface to facilitate inter-engagement with the setting arrangement and permit radial expansion of the seal element, and to provide relief between the seal element and the setting arrangement when the seal element is in the extended configuration to permit the seal element to define and function appropriately as a cup seal.

4. The seal assembly according to claim 1, wherein at least one of:

the seal element is generally cylindrical when in the retracted configuration; and the setting arrangement is operable to deform the seal element to define a general cup-shape when in the extended configuration.

5. The seal assembly according to claim 1, wherein the seal element and the setting arrangement are axially arranged relative to each other in end-to-end relationship when the seal element is in the retracted configuration.

6. The seal assembly according to claim 1, wherein the deflector defines an annular component.

7. The seal assembly according to claim 1, wherein one of:

the setting arrangement further comprises an actuator operable to provide relative movement between the seal element and the deflector; and the setting arrangement further comprises an actuator operable to provide relative movement between the seal element and the deflector, the actuator comprising a ram arrangement.

8. The seal assembly according to claim 1, wherein at least one of:

the intermediate member defines a first ramp surface for engaging the seal element to permit said seal element to be radially expanded, and a second ramp surface for engaging the deflector to permit said intermediate member to be radially expanded by the deflector;

the intermediate member comprises a metal insert;

the setting arrangement comprises a plurality of intermediate members;

the setting arrangement comprises a plurality of intermediate members-, at least one of the intermediate members is different from at least other of the intermediate members; and the setting arrangement comprises a plurality of intermediate members, at least one of the intermediate members comprises a material of different hardness.

9. The seal assembly according to claim 1, comprising a seal support arrangement for providing axial support to the seal element at least when said seal element is in the extended configuration.

10. The seal assembly according to claim 9, wherein at least one of:

the seal support arrangement is reconfigurable between a retracted configuration and an extended configuration;

the seal support arrangement is reconfigurable between a retracted configuration and an extended configuration, wherein the seal support arrangement is configured in the extended configuration simultaneously with extension of the seal element;

the seal support arrangement is activated to extend during the same activation event as the seal element;

the seal support arrangement is activated to extend by inter-engagement with the seal element, such that the seal support arrangement will be extended as the seal element is extended; and the seal support arrangement is configured to be extended by the setting arrangement.

11. The seal assembly according to claim 9, wherein the seal support arrangement comprises multiple support elements each being radially extendable to provide support to the seal element.

12. The seal assembly according to claim 11, wherein the seal support arrangement comprises a seal support deflector for displacing the support elements radially outwardly.

13. The seal assembly according to claim 12, wherein at least one of:

the seal assembly comprises a mandrel;

the seal support arrangement further comprises a limit ring mounted on the mandrel and configured to prevent or at least limit axial movement of the support elements, permitting the seal support deflector to be axially moved relative to the support elements;

the seal support arrangement further comprises a limit ring mounted on the mandrel and configured to prevent or at least limit axial movement of the support elements, permitting the seal support deflector to be axially moved relative to the support elements, and wherein one or more of the support elements are initially secured relative to the limit ring via a releasable connection;

the seal support deflector is engaged by the seal element, such that activation of the seal element to be extended by the setting arrangement causes the seal support deflector to be moved axially and thus extend the support elements;

one end region of the seal element is engaged with the seal support deflector; and at least one support element is connected to the seal support deflector.

14. The seal assembly according to claim 11, wherein at least one of:

at least one support element is rotatable about a pivot point to be moved to the extended configuration;

at least one support element is rotatable about a pivot point to be moved to the extended configuration and the pivot point of at least one support element is located externally of the respective support element;

the pivot point of at least one support element is located radially outwardly of a maximum outer dimension of the respective support element when in the extended configuration; and the pivot point of at least one support element is located radially outwardly of a wall of a bore within which the seal assembly is located.

15. The seal assembly according to claim 12, wherein one of:

the support elements and seal support deflector define corresponding curved surfaces which inter-engage to permit the support elements to be rotated, and the support elements and seal support deflector define corresponding curved surfaces which inter-engage to permit the support elements to be rotated, and wherein at least one support element comprises a planar portion or surface which is contiguous with a curved surface and is arranged to be engaged with the mandrel when said support element is moved to an extended configuration.

16. The seal assembly according to claim 1, comprising a seal back-up arrangement extending over at least a portion of the outer surface of the seal element, and wherein one of:

the seal back-up arrangement is interposed between the seal element and a seal support arrangement; and the seal back-up arrangement is interposed between the seal element and a seal support arrangement, and wherein the seal back-up arrangement is configured to span at least one circumferential gap between adjacent support elements of the seal support arrangement.

17. The seal assembly of claim 1 comprising the mandrel, wherein the radially expandable seal element is mounted on the mandrel, and the setting arrangement is mounted on the mandrel.

18. The seal assembly according to claim 17, wherein the seal element defines an annular gap with the mandrel.

19. The seal assembly according to claim 17, wherein one of:

the setting arrangement is fluid actuated; and the setting arrangement is fluid actuated by fluid delivered via the mandrel, and wherein the mandrel defines one or more selectively openable fluid ports to permit fluid communication with the setting arrangement.

20. The seal assembly according to claim 17, wherein the mandrel includes a sleeve arrangement comprising inner and outer co-axially arranged sleeves, each defining one or more fluid ports, wherein in one configuration respective fluid ports in the sleeves are misaligned with each other, thus closing any communication path between the mandrel and the setting arrangement, and in another configuration, respective fluid ports of the sleeves are aligned, thus opening a communication path between the mandrel and the setting arrangement.

21. The seal assembly according to claim 20, wherein at least one of:

the sleeves are actuated to move relative to each other to be reconfigured to selectively open the ports;

the sleeve arrangement defines a staged activation procedure, with the sleeve arrangement being configured to initially open a port or set of ports to provide communication between the mandrel and the setting arrangement and thus permit setting of the seal element, and subsequent to this open a second port or set of ports to provide communication with an annulus surrounding the mandrel;

the sleeve arrangement defines a staged activation procedure, with the sleeve arrangement being configured to initially open a port or set of ports to provide communication between the mandrel and the setting arrangement and thus permit setting of the seal element, and subsequent to this open a second port or set of ports to provide communication with an annulus surrounding the mandrel, and wherein the subsequent stage also closes the first port or set of ports.

22. The seal assembly according to claim 17, comprising a second seal element and a second setting assembly mounted on the mandrel.

23. A method for establishing or setting a seal within an annulus between a mandrel and a bore wall, the method comprising the steps of:

running a seal assembly according to claim 1 into a bore, wherein the setting arrangement comprises a deflector operable to displace the seal element radially outwardly and an intermediate member interposed between the seal element and the deflector, the seal element, the intermediate member and the deflector being axially slidable relative to each other and the mandrel to position the deflector and the intermediate member between the seal element and the mandrel in a radially stacked configuration to affect the radial expansion of the seal element; and actuating the setting arrangement to move the deflector, intermediate member between the seal element in a radially stacked configuration to displace the seal element radially outward from a retracted configuration to an extended configuration to define a cup seal.

24. A seal assembly for establishing a seal in an annulus between a mandrel and a bore wall, comprising:

a mandrel;

a radially expandable seal element mounted on the mandrel;

a seal support arrangement mounted on the mandrel and in engagement with the seal element; and a setting arrangement mounted on the mandrel and being arranged to displace the seal element radially outwardly from a retracted configuration to an extended configuration, and to cause the seal element to initiate radial extension of the seal support arrangement, wherein the setting arrangement comprises a deflector operable to displace the seal element radially outwardly and an intermediate member interposed between the seal element and the deflector, the seal element, the intermediate member and the deflector being axially slidable relative to each other and the mandrel is to position the deflector, and the intermediate member between the seal element and the mandrel in a radially stacked configuration to affect the radial expansion of the seal element, wherein the seal element comprises a fixed end region which is radially fixed, and an opposite free end region which is configured to be radially expanded by the setting arrangement.

25. A seal assembly for establishing a seal in an annulus between a mandrel and a bore wall, comprising:

a mandrel;

a radially extendable seal element mounted on the mandrel;

a radially extendable seal support assembly; and a setting arrangement mounted on the mandrel, wherein the setting arrangement comprises a deflector operable to displace the seal element radially outwardly and an intermediate member interposed between the seal element and the deflector, the seal element, the intermediate member and the deflector being axially slidable relative to each other and the mandrel to position the deflector, and the intermediate member between the seal element and the mandrel in a radially stacked configuration to affect the radial expansion of the seal element, and wherein the seal element comprises a fixed end region which is radially fixed, and an opposite free end region which is configured to be radially expanded by the setting arrangement, wherein the seal element is interposed between the setting arrangement, and the extendable seal support assembly and the setting arrangement is configured to apply a setting force on the seal element, and in turn the seal element is configured to apply a setting force on the seal support assembly to radially extend both the seal element and the seal support assembly.

26. A seal assembly for establishing a seal in an annulus between a mandrel and a bore wall, comprising:

a mandrel;

a radially expandable seal element mounted on the mandrel; and a setting arrangement mounted on the mandrel and comprising an actuator and an intermediate member arranged between the actuator and the seal element, said actuator configured to drive the intermediate member axially beneath the seal element to radially stack the intermediate member and the seal element and cause the seal element to be expanded, wherein the setting arrangement comprises a deflector operable to displace the seal element radially outwardly and the intermediate member interposed between the seal element and the deflector, the seal element, the intermediate member and the deflector being axially slidable relative to each other and the mandrel to position the deflector and the intermediate member between the seal element and the mandrel in a radially stacked configuration to affect the radial expansion of the seal element, wherein the seal element comprises a fixed end region which is radially fixed, and an opposite free end region which is configured to be radially expanded by the setting arrangement.

27. An apparatus for sealing an annulus around a tubular member, the apparatus comprising:

a tubular member;

a deformable sealing element retained around the tubular member and having a sealing portion;

a setting element slidably retained around the tubular member; the setting element operable to slide to a deployed position in which the setting element is between the tubular member and the sealing portion of the sealing element, to thereby increase an external diameter of the sealing portion, the setting element comprising a deflector operable to displace the seal element radially outwardly and an intermediate member interposed between the seal element and the deflector, the seal element, the intermediate member and the deflector being axially slidable relative to each other and the mandrel to position the deflector, and the intermediate member between the seal element and the mandrel in a radially stacked configuration to affect the radial expansion of the seal element, wherein the deformable sealing element comprises a fixed end region which is radially fixed, and an opposite free end region which is configured to be radially expanded by the setting arrangement.

28. An apparatus for sealing an annulus around a tubular member, the apparatus comprising:

a tubular member;

a deformable sealing element slidably retained around the tubular member; and a seal backup operatively engaged with the sealing element;

the sealing element operable to slide between:

a first position in which the sealing element is in a relaxed configuration and is operatively engaged with the seal backup in a retraced position; and a second position in which the sealing element is in a deformed configuration and is operatively engaged with the seal backup in an extended configuration, in which the seal backup supports at least a part of the sealing element; and a setting arrangement comprising a deflector operable to displace the seal element radially outwardly and an intermediate member interposed between the seal element and the deflector, the seal element, the intermediate member and the deflector and the intermediate member being axially slidable relative to each other and the mandrel to position the deflector between the seal element and the mandrel in a radially stacked configuration to affect the radial expansion of the seal element, wherein the deformable seal element comprises a fixed end region which is radially fixed, and an opposite free end region which is configured to be radially expanded by the setting arrangement.

29. A seal assembly for establishing a seal in an annulus between a mandrel and a bore wall, comprising:

a mandrel;

a deflector;

an intermediate member;

a radially expandable seal element mounted on the mandrel; and a setting arrangement mounted on the mandrel and being arranged to displace the seal element radially outwardly from a retracted configuration to an extended configuration, wherein the expandable seal element defines a cup seal when in the extended configuration, wherein the seal element, the intermediate member and the deflector are axially slidable relative to each other and the mandrel to position the deflector and the intermediate member between the seal element and the mandrel in a radially stacked configuration to affect the radial expansion of the seal element, wherein the mandrel includes a sleeve arrangement comprising inner and outer co-axially arranged sleeves, each defining one or more fluid ports, wherein in one configuration for running the seal assembly into a bore, respective fluid ports in the sleeves are misaligned with each other, thus closing any communication path between the mandrel and the setting arrangement, and in another configuration for radially expanding the seal element, respective fluid ports of the sleeves are aligned, thus opening a communication path between the mandrel and the setting arrangement.

30. The seal assembly according to claim 29, wherein at least one of:

the sleeves are actuated to move relative to each other to be reconfigured to selectively open the ports;

the sleeve arrangement defines a staged activation procedure, with the sleeve arrangement being configured to initially open a port or set of ports to provide communication between the mandrel and the setting arrangement and thus permit setting of the seal element, and subsequent to this open a second port or set of ports to provide communication with an annulus surrounding the mandrel;

the sleeve arrangement defines a staged activation procedure, with the sleeve arrangement being configured to initially open a port or set of ports to provide communication between the mandrel and the setting arrangement and thus permit setting of the seal element, and subsequent to this open a second port or set of ports to provide communication with an annulus surrounding the mandrel, and wherein the subsequent stage also closes the first port or set of ports.

* * * * *